US006817209B1

(12) United States Patent
Tiner

(10) Patent No.: US 6,817,209 B1
(45) Date of Patent: Nov. 16, 2004

(54) FLUID COOLED AIR CONDITIONING SYSTEM

(76) Inventor: Gordon A. Tiner, 999 New Durham Rd., Edison, NJ (US) 08817

( * ) Notice: Subject to any disclaimer, the term of this patent is extended or adjusted under 35 U.S.C. 154(b) by 0 days.

(21) Appl. No.: 10/622,726

(22) Filed: Jul. 18, 2003

(51) Int. Cl.[7] ..... F25D 17/02
(52) U.S. Cl. ..... 62/434; 62/171
(58) Field of Search ..... 62/434, 408, 171

(56) References Cited

U.S. PATENT DOCUMENTS

| | | | | | |
|---|---|---|---|---|---|
| 4,067,205 | A | | 1/1978 | Mayhue | 62/279 |
| 4,271,678 | A | * | 6/1981 | Liebert | 62/173 |
| 4,406,138 | A | | 9/1983 | Nelson | 62/305 |
| 4,667,580 | A | | 5/1987 | Wetzel | 98/34.6 |
| 4,696,168 | A | * | 9/1987 | Woods et al. | 62/200 |
| 4,964,279 | A | | 10/1990 | Osborne | 62/59 |
| 5,444,971 | A | | 8/1995 | Holenberger | 60/39.02 |
| 5,448,897 | A | | 9/1995 | Dihn | 62/333 |
| 5,493,871 | A | * | 2/1996 | Eiermann | 62/173 |
| 5,524,453 | A | | 6/1996 | James | 62/434 |
| 5,647,225 | A | | 7/1997 | Fischer et al. | 62/434 |
| 5,970,728 | A | | 10/1999 | Hebert | 62/160 |
| 6,085,532 | A | | 7/2000 | Sibik | 62/179 |
| 6,109,044 | A | | 8/2000 | Porter et al. | 62/96 |
| 6,276,152 | B1 | | 8/2001 | Sibik | 62/201 |
| 6,338,257 | B1 | | 1/2002 | Chiu et al. | 62/305 |
| 6,449,973 | B2 | | 9/2002 | Dodge et al. | 62/240 |
| 2001/0001363 | A1 | | 5/2001 | Dodge et al. | 62/240 |
| 2002/0017110 | A1 | | 2/2002 | Chiu et al. | 62/305 |
| 2002/0020185 | A1 | | 2/2002 | Carr | 62/310 |
| 2002/0088239 | A1 | | 7/2002 | Goldstein | 62/173 |
| 2003/0000230 | A1 | | 1/2003 | Kopko | 62/82 |

* cited by examiner

*Primary Examiner*—Melvin Jones

(57) ABSTRACT

A fluid cooled air conditioning system for effectively cooling a continuous flow of return air to a desired temperature. The fluid cooled air conditioning system includes a first valve fluidly connected to a chilled fluid supply, a main cooling unit connected to the first valve, a second valve connected to the main cooling unit and a chilled fluid return, and a precooling unit connected to the second valve. During normal cooling requirements, the second valve diverts the chilled fluid to the chilled fluid return instead of the precooling unit. However, during high cooling requirements, the second valve allows the chilled fluid to pass through the precooling unit for precooling the return air prior to entering the main cooling unit.

6 Claims, 6 Drawing Sheets

FLUID COOLED AIR CONDITIONING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to air conditioning systems and more specifically it relates to a fluid cooled air conditioning system for effectively cooling a continuous flow of return air to a desired temperature.

2. Description of the Related Art

Conventional air conditioning systems have been in use for years. One type of air conditioning system utilizes a liquid or gaseous refrigerant that requires the usage of a compressor and a condenser. Refrigerant cooled systems receive return air and pass the air over the condenser to reduce the temperature of the air before dispensing into a room via an air duct.

In larger buildings, refrigerant based systems run into problems because the conduit between the condenser and the air handler exceeds distance limitations, or the length of duct work becomes unmanageable. To solve these inherent problems with conventional refrigerant-based systems, "chilled water systems" are typically utilized.

In a chilled water system, the entire air conditioner is positioned upon the roof or behind the building. It cools water to between 40 and 45 Fahrenheit. This chilled water is then piped throughout the building and connected to air handlers as needed. One popular application of chilled water systems has been underfloor-air for computer rooms using false floors and the like. It is well known that computer rooms have numerous electronic heat generating devices that have high cooling requirements.

The main problem with conventional chilled water systems is that they are not capable of handling high cooling loads that can be associated with a computer room operating at peak capacity. Another problem with conventional chilled water systems is that they require large flow rates of chilled water to maintain a desirable temperature.

While these devices may be suitable for the particular purpose to which they address, they are not as suitable for effectively cooling a continuous flow of return air to a desired temperature. Conventional chilled water systems are not capable of efficiently and effectively cooling a room having high cooling requirements.

In these respects, the fluid cooled air conditioning system according to the present invention substantially departs from the conventional concepts and designs of the prior art, and in so doing provides an apparatus primarily developed for the purpose of effectively cooling a continuous flow of return air to a desired temperature.

BRIEF SUMMARY OF THE INVENTION

In view of the foregoing disadvantages inherent in the known types of air conditioning systems now present in the prior art, the present invention provides a new fluid cooled air conditioning system construction wherein the same can be utilized for effectively cooling a continuous flow of return air to a desired temperature.

The general purpose of the present invention, which will be described subsequently in greater detail, is to provide a new fluid cooled air conditioning system that has many of the advantages of the air conditioning systems mentioned heretofore and many novel features that result in a new fluid cooled air conditioning system which is not anticipated, rendered obvious, suggested, or even implied by any of the prior art air conditioning systems, either alone or in any combination thereof.

To attain this, the present invention generally comprises a first valve fluidly connected to a chilled fluid supply, a main cooling unit connected to the first valve, a second valve connected to the main cooling unit and a chilled fluid return, and a precooling unit connected to the second valve. During normal cooling requirements, the second valve diverts the chilled fluid to the chilled fluid return instead of the precooling unit. However, during high cooling requirements, the second valve allows the chilled fluid to pass through the precooling unit for precooling the return air prior to entering the main cooling unit.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a fluid cooled air conditioning system that will overcome the shortcomings of the prior art devices.

A second object is to provide a fluid cooled air conditioning system for effectively cooling a continuous flow of return air to a desired temperature.

Another object is to provide a fluid cooled air conditioning system that may be utilized in various cooling applications such as but not limited to underfloor air and computer rooms.

An additional object is to provide a fluid cooled air conditioning system that reduces the amount of chilled water required to cool heated return air.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
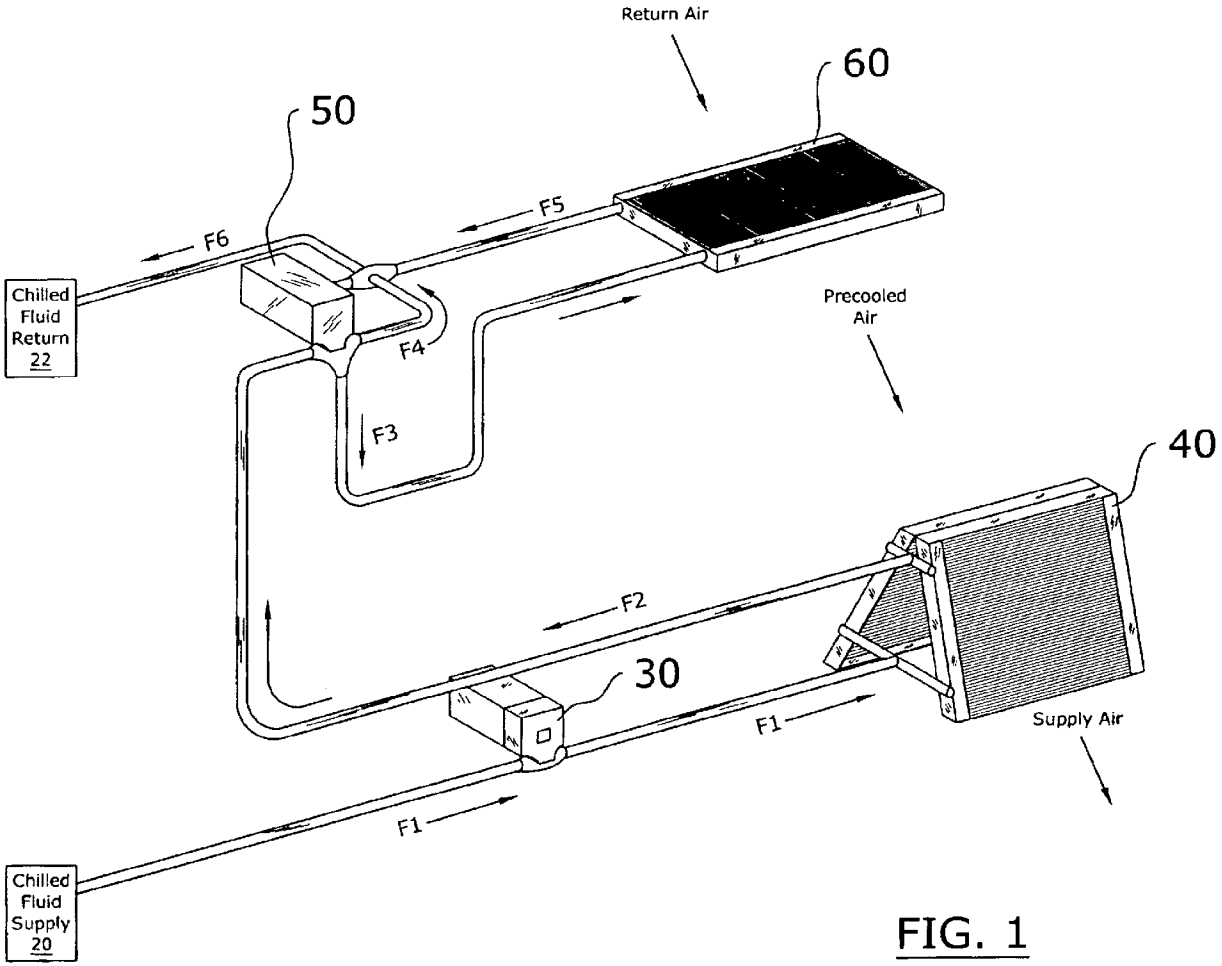
FIG. 1 is an upper perspective view of the present invention.

Turning now descriptively to the drawings, in which similar reference characters denote similar elements throughout the several views, FIGS. 1 through 6 illustrate a fluid cooled air conditioning system 10, which comprises a first valve 30 fluidly connected to a chilled fluid supply 20, a main cooling unit 40 connected to the first valve 30, a second valve 50 connected to the main cooling unit 40 and a chilled fluid return 22, and a precooling unit 60 connected to the second valve 50. During normal cooling requirements, the second valve 50 diverts the chilled fluid to the chilled fluid return 22 instead of the precooling unit 60. However, during high cooling requirements, the second valve 50 allows the chilled fluid to pass through the precooling unit 60 for precooling the return air prior to entering the main cooling unit 40.

B. Chilled Fluid System

Figure 3:
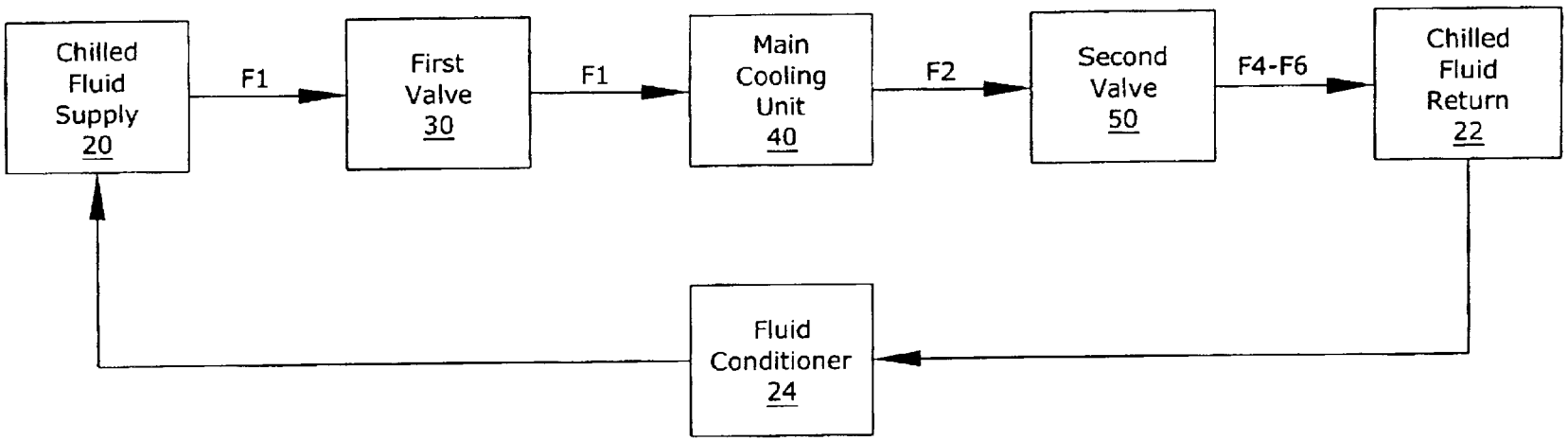
FIG. 3 is a block diagram illustrating the fluid flow during normal cooling requirements.
Figure 4:
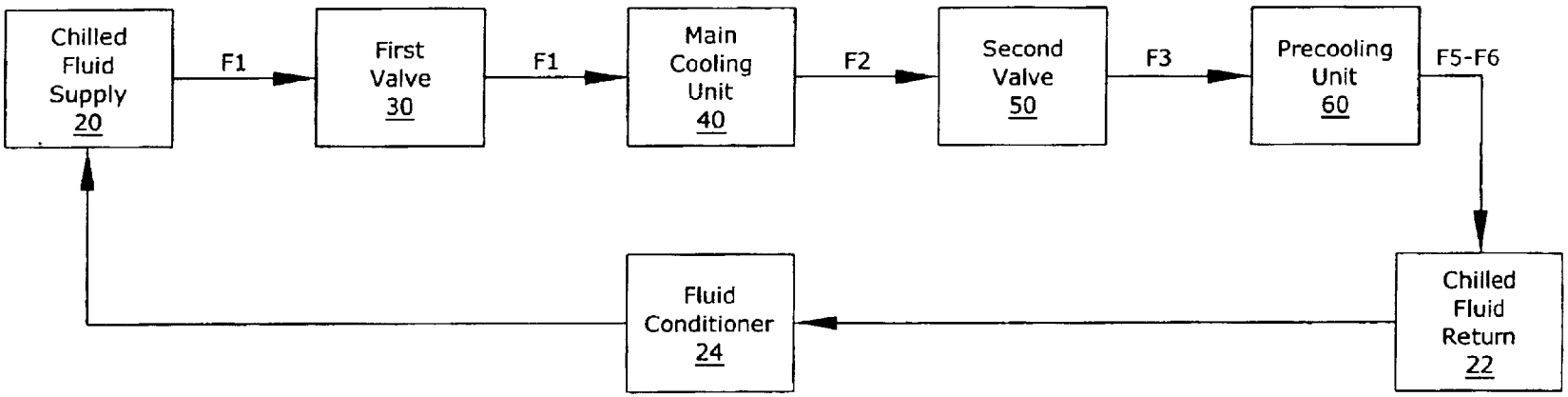
FIG. 4 is a block diagram illustrating the fluid flow during high cooling requirements whereby the chilled fluid passes through the precooling unit.

The chilled fluid system may be comprised of any conventional chilled fluid system commonly utilized within the air conditioning industry. The chilled fluid system may utilize various types of fluid such as but not limited to water. The chilled fluid system has a chilled fluid return 22 for collecting the heated fluid, a fluid conditioner 24 for chilling the heated fluid, and a chilled fluid supply 20 for providing the chilled fluid to the present invention as shown in FIGS. 3 and 4 of the drawings. The fluid conditioner 24 reduces the temperature of the fluid through a heat exchange process.

C. First Valve

The first valve 30 fluidly is connected to the chilled fluid supply 20 as shown in FIGS. 1, 3 and 4 of the drawings. The first valve 30 receives a fluid flow F1 and controls the flow to the main cooling unit 40 depending upon the cooling requirements. The fluid flow F1 preferably has a temperature of approximately 45 degrees, however various other temperatures may be utilized.

D. Main Cooling Unit

The main cooling unit 40 is fluidly connected to the first valve 30 as shown in FIGS. 1, 3 and 4 of the drawings. The main cooling unit 40 is preferably comprised of a cooling coil structure wherein the fluid flow F1 passes through the coils thereby conducting heat from the precooled air from the precooling unit 60.

The fluid leaves the main cooling unit 40 as fluid flow F2 wherein the temperature of fluid flow F2 may be approximately 55 degrees depending upon the amount of heat conducted from the airflow. The supply air leaving through the main cooling unit 40 is preferably approximately 55 degrees, however various other temperatures may achieved for the supply air as shown in FIGS. 1 and 2 of the drawings.

E. Precooling Unit

Figure 2:
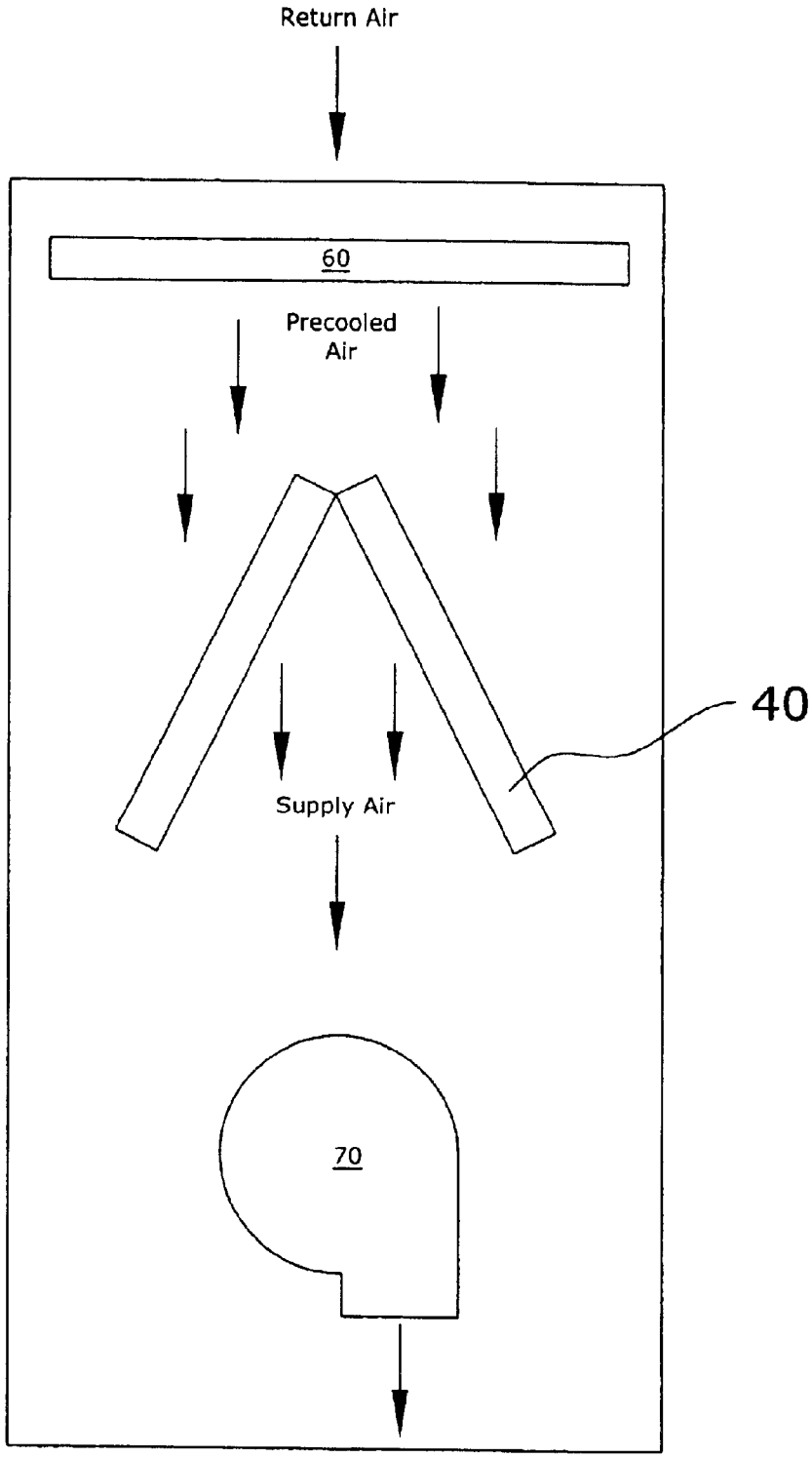
FIG. 2 is a top view of the present invention illustrating the airflow.

The precooling unit 60 is positioned to receive return air prior to the main cooling unit 40 as shown in FIGS. 1 and 2 of the drawings. The precooling unit 60 is fluidly connected to the second valve 50 as shown in FIGS. 1, 3 and 4 of the drawings. The precooling unit 60 is preferably comprised of a cooling coil structure wherein the fluid flow F3 from the second valve 50 passes through the coils thereby conducting heat from the return air.

The fluid leaves the precooling unit 60 as fluid flow F5 as shown in FIG. 1 of the drawings. The fluid flow F5 is then combined with the diversion fluid flow F4 to form fluid flow F6 as shown in FIG. 1 of the drawings. The second valve 50 determines the flow rate of the chilled fluid that passes through the precooling unit 60 based upon the cooling requirements of the system.

F. Second Valve

The second valve 50 is fluidly connected between the main cooling unit 40 and a chilled fluid return 22 and the precooling unit 60 as shown in FIG. 1 of the drawings. The second valve 50 directs the chilled fluid to the precooling unit 60 during periods of high cooling requirements and diverts the chilled fluid to the chilled fluid return 22 during periods of normal cooling requirements.

The second valve 50 is preferably a three-way valve structure, however various other structures may be utilized. The periods of high cooling requirements occur when the room temperature exceeds 75 degrees Fahrenheit, though various other set points may be utilized to determine when chilled fluid is diverted through the precooling unit 60.

G. Control Unit

Figure 6:
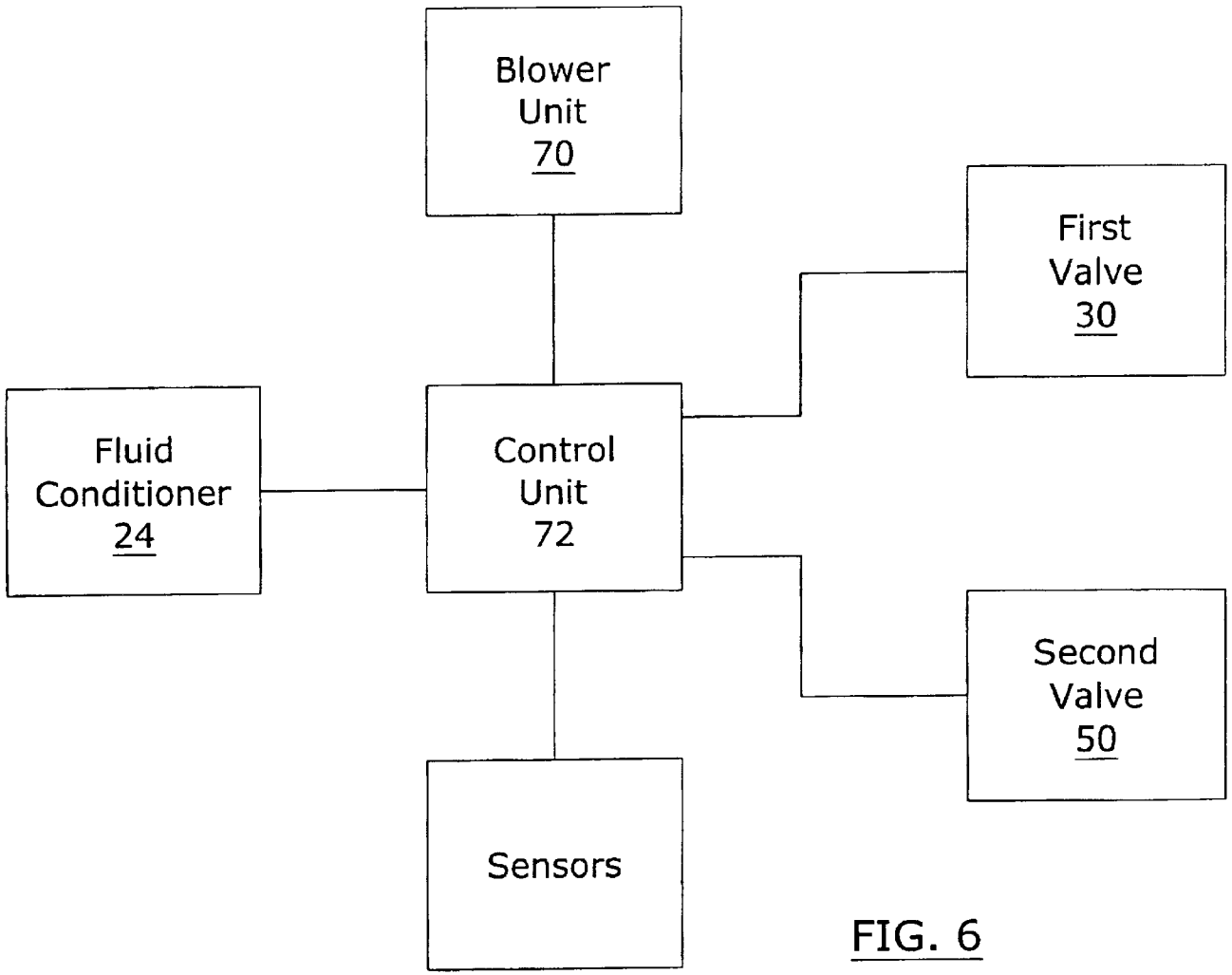
FIG. 6 is a block diagram of the present invention illustrating the electrical connections and communications between the electrical components.

A control unit 72 is in communication with the first valve 30, the second valve 50, a blower unit 70, the fluid conditioner 24 and sensors as shown in FIG. 6 of the drawings. The control unit 72 is preferably programmable for allowing the setting of various set points at various periods of time. The blower unit 70 draws the return air through the precooling unit 60 and then through the main cooling unit 40 as shown in FIG. 2 of the drawings.

The control unit 72 receives input data from the sensors regarding return air conditions, precooled air conditions, supply air conditions, room air conditions and fluid flow conditions. The air conditions monitored by the control unit 72 include but are not limited to temperature, flow rate, humidity, pressure and the like. The fluid conditions monitored by the control unit 72 include but are not limited to temperature, flow rate, pressure and the like. The control unit 72 adjusts the first valve 30 and the second valve 50 according to the preprogrammed settings and the input data.

H. Operation

Figure 5:
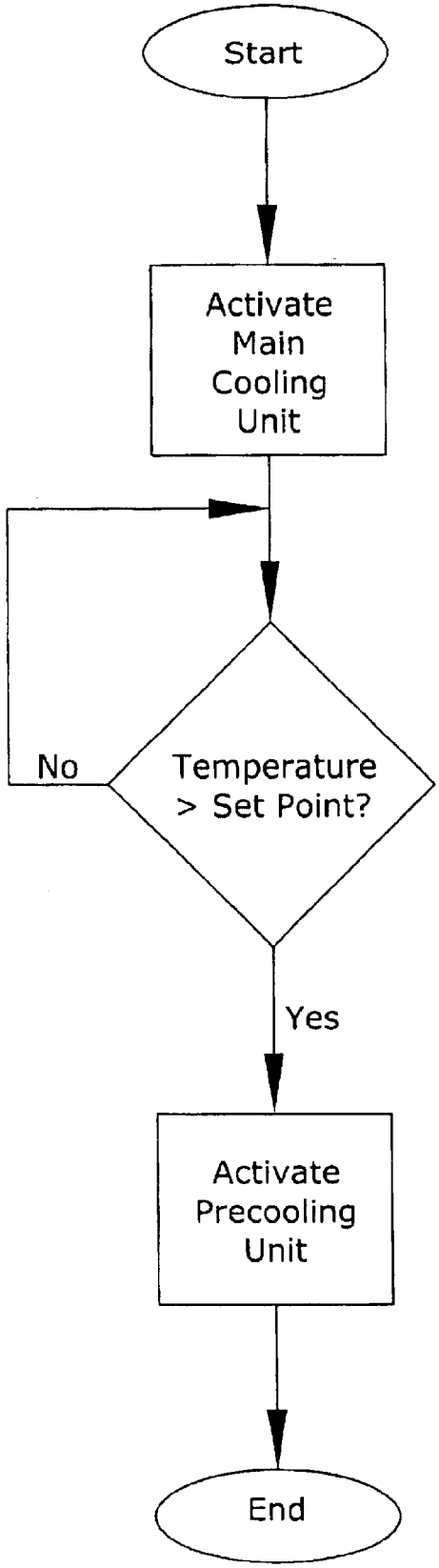
FIG. 5 is a flow chart illustrating the overall functionality of the present invention.

FIG. 5 illustrates the overall operation of the present invention. During the initial stages of operation during normal cooling requirements, only the main cooling unit 40 is activated by the opening of the first valve 30 as shown in FIG. 3 of the drawings. The second valve 50 diverts the chilled coolant to the child fluid return as shown in FIG. 3 of the drawings. The first valve 30 may be adjustable for allowing controlling of the flow of the chilled fluid to the main cooling unit 40 depending upon cooling requirements. The return air thereby passes through the precooling unit 60 without any cooling occurring and then entering the main cooling unit 40 as shown in FIGS. 1 and 2 of the drawings.

If the cooling requirements are high (e.g. the room temperature exceeds 75 degrees, etc.), the second valve 50 is thereby manipulated to allow chilled fluid to enter the precooling unit 60. The fluid flow F3 that enters the precooling unit 60 is approximately 55 degrees after being heated by the main cooling unit 40. The fluid flow F5 that leaves the precooling unit 60 may have a temperature of approximately 65 degrees after conducting the heat from the return air. For example, the return air temperature may range between 75–95 degrees with the precooling unit 60 reducing the temperature of the precooled air exiting the precooling unit 60 to approximately 75 degrees. The precooled air then enters the main cooling unit 40 where the precooled air is further cooled to a temperature of approximately 55 degrees. Various other temperature ranges may be achieved within the present invention as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Fluid Cooled Air Conditioning System (TINE-002)

ENVIRONMENTAL ELEMENTS

| | |
|---|---|
| 10. Fluid Cooled Air Conditioning System | 50. Second Value |
| 11. | 51. |
| 12. | 52. |
| 13. | 53. |
| 14. | 54. |
| 15. | 55. |
| 16. | 56. |
| 17. | 57. |
| 18. | 58. |
| 19. | 59. |
| 20. Chilled Fluid Supply | 60. Precooling Unit |
| 21. | 61. |
| 22. Chilled Fluid Return | 62. |
| 23. | 63. |
| 24. Fluid Conditioner | 64. |
| 25. | 65. |
| 26. | 66. |
| 27. | 67. |
| 28. | 68. |
| 29. | 69. |
| 30. First Valve | 70. Blower Unit |
| 31. | 71. |
| 32. | 72. |
| 33. | 73. |

-continued

Index of Elements for Fluid Cooled Air Conditioning System (TINE-002)

ENVIRONMENTAL ELEMENTS

| | |
|---|---|
| 34. | 74. |
| 35. | 75. |
| 36. | 76. |
| 37. | 77. |
| 38. | 78. |
| 39. | 79. |
| 40. Main Cooling Unit | |
| 41. | |
| 42. | |
| 43. | |
| 44. | |
| 45. | |
| 46. | |
| 47. | |
| 48. | |
| 49. | |

I claim:

1. A fluid cooled air conditioning system, comprising:

a first valve fluidly connected to a chilled fluid supply providing a chilled fluid;

a main cooling unit fluidly connected to said first valve;

a precooling unit, wherein said precooling unit is positioned to receive return air prior to said main cooling unit; and a second valve fluidly connected between said main cooling unit and a chilled fluid return and said precooling unit, wherein said second valve directs said chilled fluid to said precooling unit during periods of high cooling requirements and wherein said second valve diverts said chilled fluid to said chilled fluid return during periods of normal cooling requirements.

2. The fluid cooled air conditioning system of claim 1, wherein said second valve is a three-way valve.

3. The fluid cooled air conditioning system of claim 2, wherein said periods of high cooling requirements occur when a room temperature exceeds 75 degrees Fahrenheit.

4. The fluid cooled air conditioning system of claim 1, including a control unit in communication with said first valve and said second valve, wherein said control unit controls said first valve and said second valve.

5. A method of operating a fluid cooled air conditioning system, comprising the steps of:

(a) providing a chilled fluid to a main cooling unit; and (b) directing chilled fluid from said main cooling unit to a precooling unit if a room temperature is greater than a set point, wherein said precooling unit receives a flow of return air and wherein said main cooling unit receives a flow of precooled air from said precooling unit.

6. The fluid cooled air conditioning system of claim 5, wherein said set point 75 degrees Fahrenheit.

* * * * *